US007887427B1

(12) United States Patent
Schmidt et al.

(10) Patent No.: US 7,887,427 B1
(45) Date of Patent: Feb. 15, 2011

(54) APPARATUS AND METHOD FOR COMPUTING AND OUTPUTTING GOLF BALL PUTTING INSTRUCTIONS

(76) Inventors: Gary E. Schmidt, 1583-A Redford Dr., Palm Springs, CA (US) 92264; Philip A. Schmidt, 7256 Gerard Dr., Eden Prairie, MN (US) 55346

( * ) Notice: Subject to any disclaimer, the term of this patent is extended or adjusted under 35 U.S.C. 154(b) by 0 days.

(21) Appl. No.: 11/696,727

(22) Filed: Apr. 5, 2007

Related U.S. Application Data

(63) Continuation of application No. 10/652,694, filed on Aug. 29, 2003, now Pat. No. 7,220,187.

(60) Provisional application No. 60/411,288, filed on Sep. 16, 2002.

(51) Int. Cl.
*G06F 17/00* (2006.01)
*G06F 19/00* (2006.01)

(52) U.S. Cl. ..... 473/173; 473/131; 473/151; 473/198; 473/252; 473/253; 473/199

(58) Field of Classification Search ..... 473/131, 473/151, 198–199, 252–253, 225, 241, 404, 473/407, 409, 174
See application file for complete search history.

(56) References Cited

U.S. PATENT DOCUMENTS 3,868,692 A * 2/1975 Woodard et al. ..... 342/458
4,053,755 A * 10/1977 Sherrill ..... 702/160
4,137,448 A * 1/1979 Smith ..... 235/78 G
5,423,547 A * 6/1995 Puso ..... 473/213
5,593,156 A * 1/1997 Jambor ..... 40/584
5,788,583 A * 8/1998 Agulnek et al. ..... 473/225
6,146,283 A * 11/2000 Ferguson, III ..... 473/145
6,165,083 A * 12/2000 Stenger et al. ..... 473/404
6,458,035 B1 * 10/2002 Katayama ..... 473/199
6,561,917 B2 * 5/2003 Manwaring ..... 473/151
6,579,190 B2 * 6/2003 Yamamoto ..... 473/141
6,616,543 B1 * 9/2003 Gobush et al. ..... 473/199
6,671,642 B2 * 12/2003 Miyamoto et al. ..... 702/109
6,764,412 B2 * 7/2004 Gobush et al. ..... 473/199
6,782,118 B2 * 8/2004 Verga ..... 382/106
6,834,129 B2 * 12/2004 Asakura ..... 382/289

* cited by examiner

*Primary Examiner*—John M Hotaling, II
*Assistant Examiner*—Ryan Hsu
(74) *Attorney, Agent, or Firm*—Albert W. Watkins

(57) ABSTRACT

Apparatus and a method for computing and outputting a putting backstroke instruction for a planned putt of a golf ball during recreational play. A computing means includes means for initializing or customizing according to a specific golfer putting on a specific golf green, the golfer putting at least one initializing putt a pre-selected distance on a level area of a green. During recreational play thereafter, in the preferred embodiment of the invention, the golfer, for each segment of a planned putt enters the applicable grade and length. The computing means outputs to the golfer an instruction for the length of the backstroke recommended, i.e., required for the planned putt. Another embodiment of the invention requires the inputting of the length of the planned putt but excludes the inputting of the grade of the green.

15 Claims, 7 Drawing Sheets

PWD
START
140
130'
130
INITIALIZING
GOLFER ENTERS
BACKSTROKE
DISTANCE "d"
GOLFER
PREPARATION
1."D"=10 PACES
140'
TO RECREATIONAL PLAY
150
SINGLE SEGMENT
GOLFER ENTERS
SEGMENT LENGTH
IN PACES
150'
170
COMPUTING OUTPUT MEANS
PROVIDES INSTRUCTION TO
GOLFER FOR RECOMMENDED
LENGTH OF PUTTING BACKSTROKE

APPARATUS AND METHOD FOR COMPUTING AND OUTPUTTING GOLF BALL PUTTING INSTRUCTIONS

CROSS REFERENCE TO PRIOR APPLICATIONS

This application is a continuation of U.S. patent application Ser. No. 10/652,694 filed Aug. 29, 2003 now U.S. Pat. No. 7,220,187 and presently allowed, which in turn claims the benefit of U.S. Provisional Patent Application filed Sep. 16, 2002, Ser. No. 60/411,288, the contents of each which are incorporated herein by reference.

FIELD OF INVENTION AND DESCRIPTION OF BACKGROUND PRIOR ART

This invention provides both apparatus and a method for computing and outputting a putting instruction, i.e., length of backstroke, to a golfer to enable the golfer to consistently putt a golf ball on a golf putting green either into or very close to the golf cup or hole with a single putt, regardless of the length of the putt or of inclines or declines of the putting surface grade. If the ball does not go into the cup on the first putt, the ball will be sufficiently close to the cup so that a second putt will, in almost all cases, putt the golf ball into the cup. In short, the golfer should not have to experience the frustration of 3-putts (or more) when using the methodology and apparatus provided by our invention.

There are, of course, many putting techniques which have evolved over the long history of the game of golf. Many are based on having a plan for the golfer to have his or her putter impact the golf ball along an intended path with a striking force which is hoped to result in the golf ball either going into the cup or lying close thereto. The reality of these prior putting methods or techniques is that, all too often, a long putt will not result in the ball being in the cup or even close thereto; therefore, a second "longish" putt is required and, frequently, these "second" putts also do not go into the cup. The golfer may or may not "hole" the third putt.

The problems of putting inaccuracy and inconsistency not only apply to many recreational golfers, but also can apply to professional golfers. For example, at the 2003 British Open, a very famous golfer from the United States had four putts on one hole; a disappointing event likely to prevent the winning of the tournament.

Golf teachers sometimes use apparatus to teach and train golfers putting in combination with methodology. Factors frequently considered include planning the putt, the golfer's stance relative to the ball, and arm movement or rotation relative to the body trunk. Practice is of course very important. However, the typical golfer will continue to have more 3-putt greens (or worse) than would be desired.

There are some patented apparatus in the prior art intended to help the golfer become a better putter. U.S. Pat. No. 4,005,870 teaches a method of training a golfer to use a machine to "define" a putt and a putting plane following which the golfer attempts to successfully stroke the ball using the putting plane as a guide. Obviously, the machine cannot be used in recreational play. During recreational play, the golfer tries to put into practice the lessons learned, similar to having received training from a golf putting teacher.

U.S. Pat. No. 5,423,538 also provides a training device for the practicing of a golf stroke. An apparatus includes first and second indicia means for indicating a range of selectable backstroke and forward stroke lengths. Again, the device is solely directed to training and cannot be used during actual play, whether recreational play or regulation play.

U.S. Pat. No. 6,146,283 discloses a golf putting training device that factors in the "stimp number or factor" of a simulated green into a microprocessor. The golfer student strikes a golf ball held on a cross piece of a rotatable shaft. A display will indicate the distance a golf ball would have traveled for the force of the impact on the ball. Again, this patent teaches a training machine that could not be used during recreational play.

It should be noted that the above discussed U.S. patents all relate to the "training" of a golfer. The golfer, after the training, is on his or her own during recreational play.

Our invention is, importantly, quite different from the prior art in that our method and apparatus provides "real time" (during recreational play) "instructions" to the golfer regarding the length of the backstroke required for a successful putt.

SUMMARY OF THE INVENTION

The present invention provides a methodology and apparatus for use by a golfer in recreational play. The apparatus is a very small, portable, and self-contained computing means. Our invention provides the golfer with a putting instruction advising the length of the backstroke required for a specific putt of a golf ball to travel from an initial location on the green to the cup. Our invention is implemented by development of algorithms representative of the rolling of a golf ball on a green under a variety of scenarios followed by the creation of software to quantify the algorithms.

The present invention recognizes that the travel of a golf ball across a putting green is directly affected by factors including, primarily, gravity and the frictional resistance of the green surface; such frictional resistance is sometimes expressed in terms of a "stimp number or factor." During the golfer's backstroke initializing step of our method, the frictional resistance of the green is, in effect, measured and is factored into the computation of all backstroke putting instructions thereafter provided to the golfer during recreational play.

The preferred embodiment of our invention also factors in the pre-determined length of a planned putt and also the grade, i.e., level, incline or decline, of a planned putt. The invention is further fully able to accommodate a planned putt having more than one segment, a segment being defined as the distance to be traveled by the golf ball for that part of the putting green of a planned putt which has the same grade. While many putts are a single segment, two and three-segment green putts are common especially with multi-tiered greens. For an example of a three-segment putt, the planned travel of the ball from its initial position is across a first segment of the green, thence up an inclined grade (the second segment) to and across a third segment to the cup. The length and grade of each segment is pre-determined by the golfer and inputted into a computing and outputting apparatus for providing to the golfer an instruction for the length of the putting backstroke required to putt the golf ball either into or close to the hole or cup.

The real time green resistance or stimp number for the green would have been first indirectly determined by the golfer following a backstroke initializing procedure as follows:

(A) A "factory pre-selected" distance is marked on a "factory pre-selected" grade of a putting green on the golf course to be thereafter played. The golfer would be advised to mark off said pre-selected distance by walking a pre-determined number of the golfer's walking paces, e.g., ten paces. The marking would be of two spaced-apart marked points on the green. The pre-selected grade could be a substantially level area on the green or could be a grade other than level. In the preferred embodiment, the pre-selected grade would be a level grade;

(B) The golfer would (using his or her putter) putt at least one golf ball (more if necessary) from the first of said marked points toward the second of said points, this step being repeated, as necessary, until the putted golf ball comes to rest at or very close to the second of said points. Importantly, the length of the backstroke that produced the desired result is noted; and (C) The noted length of the backstroke is inputted into the computing means. While the "level" grade of the green and the ten pace pre-determined distance would have been pre-selected and pre-programmed into the computing means at the time of manufacture of the apparatus, it should be understood that such pre-programmed specifics are for the purpose of establishing reference bases in the computing means and that other pre-selected grades and distances could be used for the same purpose.

The computing means comprises input means and output means. An example of an input means is a keypad and the output means could be a visual display, but other input and output means also may be used. The computing means would usually utilize integrated circuit-type digital technology programmed in accordance with the principles of our invention.

The computing means for the preferred embodiment of our invention includes means for the golfer to selectively use, for a planned putt, one of a plurality of putting green surface grades ranging between uphill or inclined grades, to a level grade, to downhill or declining grades. The golfer inputs the grade for each segment of the planned putt.

Further, the computing means includes means for the golfer to input the predetermined length of each segment of a planned putt.

As indicated, the backstroke initializing procedure is easily and quickly done by the golfer pacing off and marking the factory set pre-selected distance on the factory set pre-selected grade of the green followed by the golfer inputting into the computing means the noted length of backstroke. If the initializing is done at a time close to the beginning of S recreational play, then the condition of the greens for actual play may be assumed to be similar to the condition of the green upon which the backstroke initializing procedure was performed.

The golfer is now ready for recreational play. The computing means for the preferred embodiment of our invention is a relatively small, hand-held, portable, self-contained apparatus. The small size permits easy carrying of the computing means in a pocket or the like. For each planned putt, the golfer, having first inputted the backstroke initializing data, for each planned putt of recreational play merely, for each segment, inputs the length and slope thereof. The output means of the computing means immediately provides the golfer with an instruction of the recommended length of the backstroke required for the golfer to use to strike the golf ball to achieve the desired result of the golf ball to either go into the cup or very close thereto.

Another, somewhat simplified embodiment of our invention is shown and described herein; it is similar to the above-described preferred embodiment but excludes the inputting of data relating to the grade(s) of the putting green.

DESCRIPTION OF THE DRAWINGS

FIG. 3 is an enlarged view of a portion of FIG. 2 and FIG. 4 is a view of FIG. 3 as viewed along section lines 4-4 thereof;

DETAILED DESCRIPTION OF THE INVENTION

Figure 1:
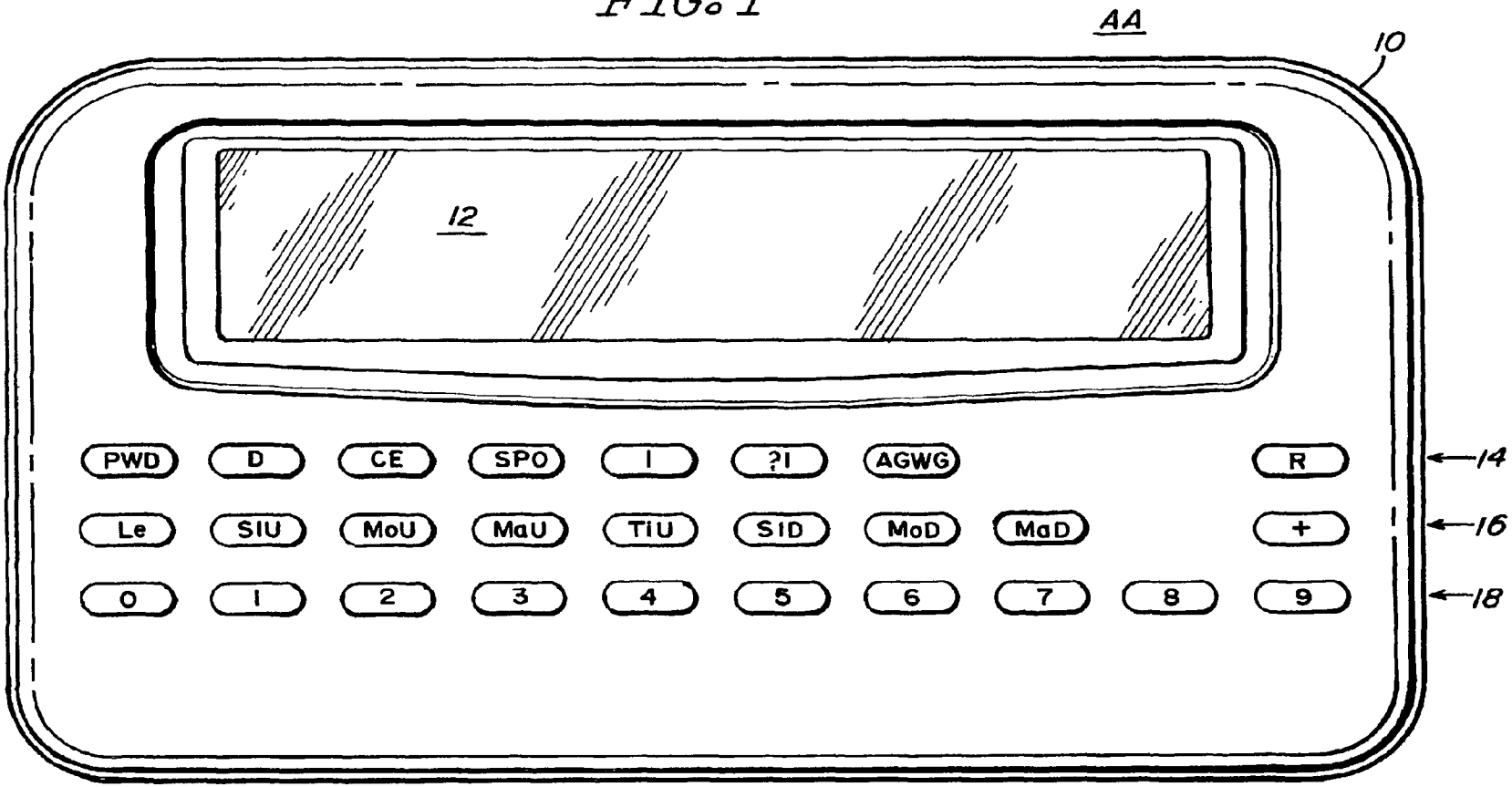
FIG. 1 is a showing of the front of a computing means for our invention including input means in the form of a keypad and output means in the form of a display window.

FIG. 1 shows the front of a computing means AA having a housing 10 containing, typically, integrated circuit means (not shown) programmed in accordance with the methodology of our invention. An output means 12 is integral with the housing 10. The specific output means depicted is a visual display means for displaying, using well known technology, alpha-numeric text as well as symbolic figures. It should be understood that other output means may be used in place of or in addition to the visual display means 12, examples being depicted in FIGS. 10 and 11.

The computing means AA further comprises input means. The specific input means depicted is a keypad means but it should be understood that other input means may be used in place of, or in addition to, the keypad means illustrated in FIG. 1, one example being shown in FIG. 9.

The keypad means depicted in FIG. 1 has three horizontal rows 14, 16 and 18 of spaced-apart keys, each of which is separately designated as shown in FIG. 1.

Beginning at the left end of the top row 14, the first key is labeled "PWD", actuation of which turns the power for the computing means AA on or off. The next key to the right is "D" for "Determine" or set the system for the current day's course condition. The next key to the right is "CE", used to clear the preceding entry. Next to the right is "SPO", used to start the putt computation over. Next to the right is "I" or input, used to input the backstroke distance or putting force for the initializing procedure. Next to the right is "?I", used for displaying current stored backstroke setup value that was last entered. The next key to the right is "AGWG", i.e., against the grain or with the grain-of the grass of the green.

The last key on the right end of row 14 is "R" for results, to display the "Instruction" as the recommended length of the backstroke for the putt.

Row 16 contains keys for inputting the slope or grade of a segment of a planned putt. Beginning at the left end of row 16, the first key is "Le" for "level"; next is "SIU" for "slightly uphill"; next is "MoU" for "moderately uphill"; next is "Mali" for "major uphill"; and next is "TiU" for "tiered uphill" or the steepest of the uphill grades. The downhill keys are "SID" for "slightly downhill", "MoD" for "moderately downhill" and "MaD" for "major downhill". The last key on the right end of row 16 is "+", i.e., "plus" which is used to add a segment to all prior segments in a multi-segment scenario.

Initialization

On the day of a planned round of recreational golf, the golfer first initializes the computer for the golfer's actual putting strokes, more specifically, for the golfer's backstroke required for stroking a golf ball a pre-selected distance on a pre-selected grade on the surface of a green at the golf course where the golfer plans to play. As is well known, the golf course greens have variable stimp numbers or resistance to the rolling of a golf ball, the variation being a direct function of type of grass, length, and "grain" of the grass, and surface conditions such as presence or absence of moisture. A key reason for the successful results derived from using our invention is that we, during the initializing step of our method, in effect are indirectly measuring the stimp number or resistance of the greens.

Figure 2:
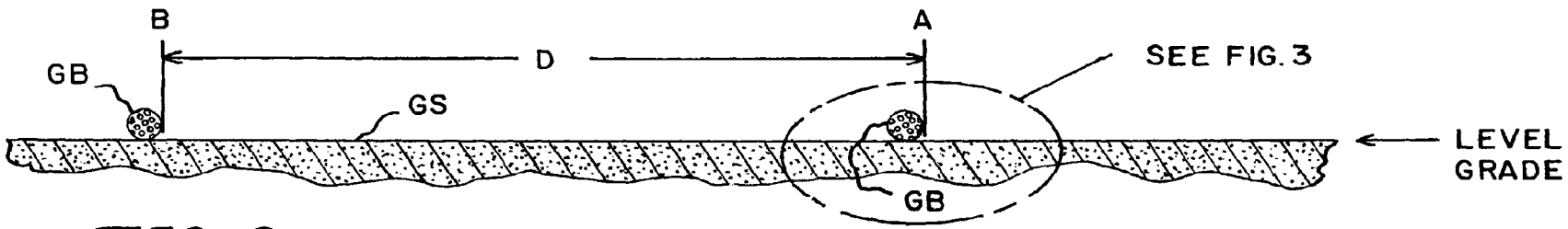
FIGS. 2, 3 and 4 are diagrams relating to the backstroke initializing of the computing means.
Figure 3:
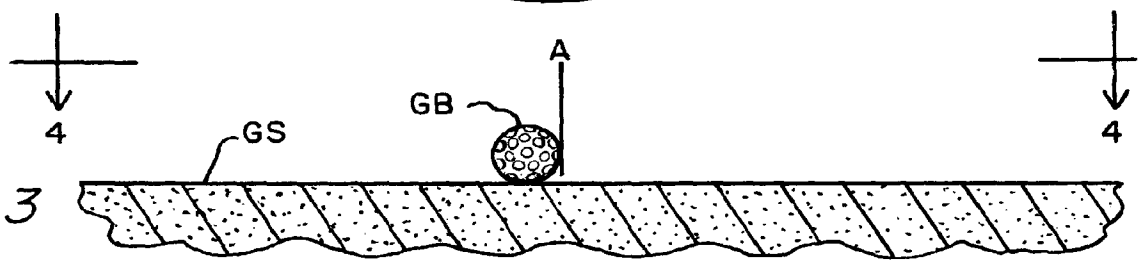
Figure 4:
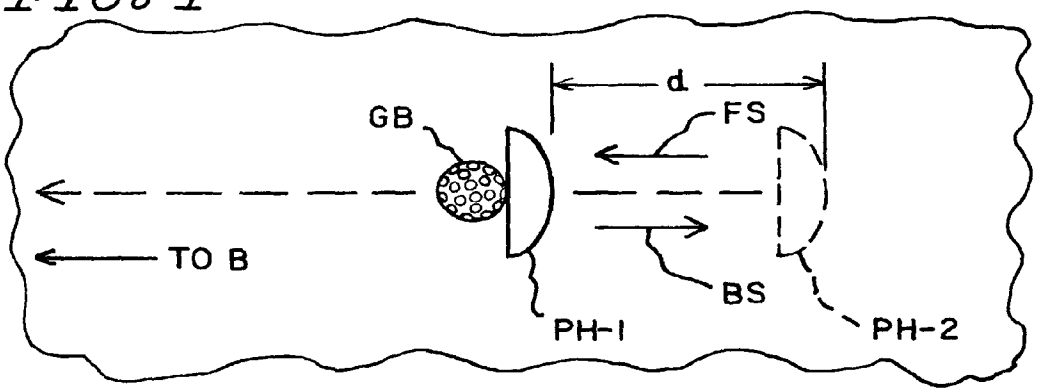

The initializing is diagramed in FIGS. 2-4. In FIG. 2, a green surface GS is shown having a level grade. For our preferred embodiment, a level grade is assumed by the pre-programming of the computing means, which assumption is valid for almost all golfing scenarios, i.e., the golfer can usually easily find a substantially level area on a putting green for the initializing. The term "grade" is defined as the degree of rise or descent of a surface. Because the level grade had been pre-programmed into the computing means, the golfer does not have to input the grade.

As shown in FIG. 2, the golfer marks a pre-selected distance D on the green surface GS by placing appropriate marks A and B a pre-selected distance of ten of the golfer's paces. As discussed above, the computer is pre-programmed for the pre-selected distance D being ten paces; thus, the golfer does not have to input the distance D into the computer. Very importantly, the golfer's "walking" pace will also be used, both for the initializing and during recreational play, to measure the lengths of the segments of the planned putts. Different golfers will, of course, have different length paces; this does not matter. The computing means will receive "distance" information based on the length of the pace of the golfer who will be doing the putting and whose paces will be used for (a) the actual measurement or "laying out" of the distance D for the initializing step of the method as well as (b) the measuring of the lengths of the segments during actual recreational play.

The golfer then putts at least one golf ball GB from the first marked point A toward the second marked point B using the golfer's putting stroke; this is diagrammed in FIGS. 3 and 4. In FIG. 4, the golf ball is shown at marked point A; adjacent thereto is the golfer's putter head PH-1. Next, the putter initiates a backstroke BS a noted distance "d" to the end point of the backstroke designated PH-2, following which the forward stroke FS of the putter serves to have the putter head contact the golf ball GB and move the ball on a path P toward the second marked point B. The first golf ball so putted may be satisfactory, i.e., sufficiently close to the marked point B as judged by the golfer, if so the golfer should note the distance of the backstroke which produced the satisfactory initializing putt. If the first initializing putt was not satisfactory, then the golfer putts one or more additional putts until the putter is satisfied with a putt; the backstroke distance "d" for that putt is noted by the golfer for input into the computing means. Said noting of the length of the "successful" backstroke is very important because this length, as inputted data, becomes a critical base reference for putts made during recreational play.

The golfer then inputs into the computing means AA, using the keypad input means, the noted length "d" of the backstroke that produced the satisfactory putt. Assuming that the power key "PWD" was "on", then the golfer inputs the noted length of the backstroke by keying key "I" in row 14 followed by the appropriate numeric key in row 18. For example, if the length of the backstroke had been determined by the judgment of the golfer to be eight inches, then the "8" key in row 18 would be keyed.

Thus, the golfer can, with a single entry of the backstroke data, initialize the computing means.

The preferred embodiment of our invention utilizes the ability of a golfer to visually appraise the surface of a putting green so as to make a pre-determination of the grade of each segment of a planned putt and to input each of such grades into the computing means AA.

Our invention is also based upon the ability of a golfer to make a judgment to measure and to control the length of the golfer's putting backstroke. The length of the backstroke "d" of FIG. 4 is purely as judged by the golfer. If the golfer judges his or her backstroke, for example, as being 7 inches when it is actually 9 inches, it doesn't matter because the golfer will be using his or her judgment in determining all backstroke distances required during recreational play in executing each backstroke as INSTRUCTED by the computer means AA as will be discussed below.

Use of Our Method and Apparatus During Recreational Play

Figure 5:
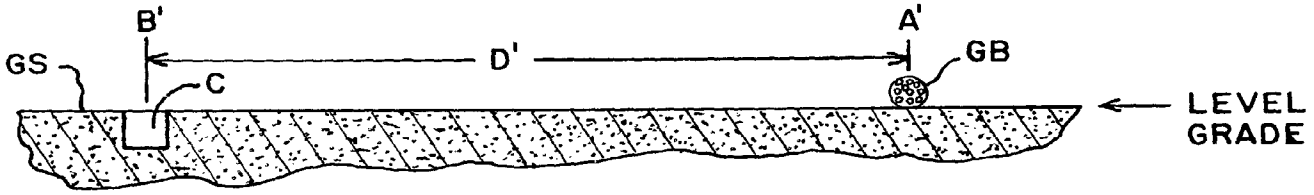
FIGS. 5, 6 and 7 are diagrams of single segment putt parameters respectively for a level grade putt, an inclined grade putt, and a declined grade putt.
Figure 6:
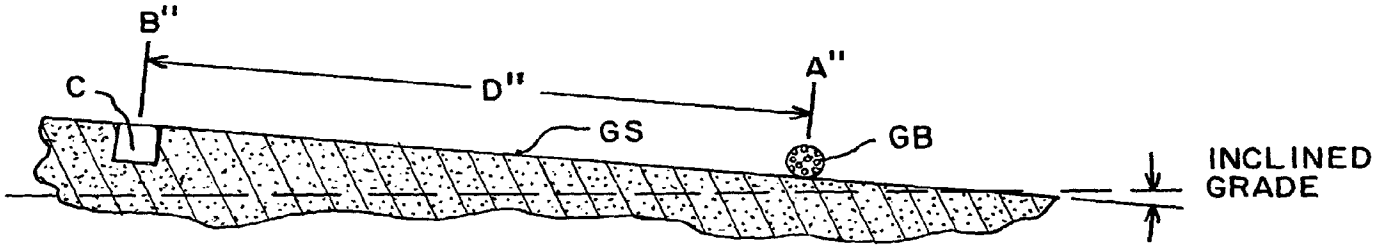
Figure 7:
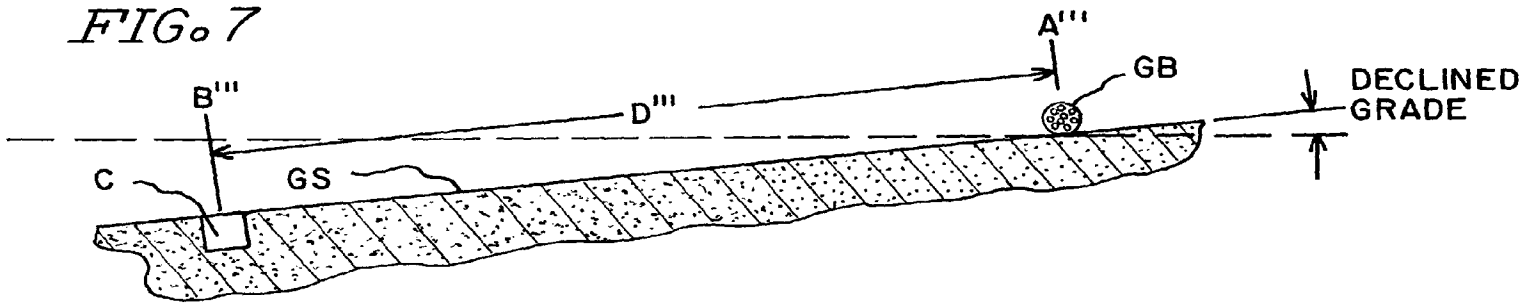

FIGS. 5, 6 and 7 are diagrams of single-segment putting green scenarios. Assume, for a hypothetical example, that the computing means had already been initialized and that the length of the "successful" backstroke was eight (8) inches.

FIG. 5 depicts a level grade for the green surface GS, the level grade of the green being a predetermination made by the golfer. The golf ball GB is at A', the cup C is at B' (the distance between A and B is D' and the golfer measures off the distance D', the measurement being expressed as the number of the golfer's paces. In FIG. 6, the golfer makes a predetermination of the degree of incline of the depicted inclined grade and measures the distance D" between the golf ball GB at A" and the cup at B".

In FIG. 7, a "downhill" grade, the golfer will make a predetermination of the degree of the declining grade and measure the distance D'" between the golf ball GB at A'" and the cup at B'".

For each of the single-segment planned putt scenarios of FIGS. 5-7, the golfer will input into the previously initialized computing means the applicable grade and distance from the golf ball to the cup; the "R" key of AA is touched and the computing means will immediately output the instruction to the golfer of the length of the required backstroke to have the golf ball putted either into the cup or close thereto.

Thus, for the example of the putting scenario of FIG. 5, assume that the golfer had pre-determined a level grade of the green and a distance D' of 14 paces. The golfer would first activate the computing means by touching the "Power" or PWD key. Then the golfer would touch key "Le" (for a level grade), then keys 1 and 4 in row 18 (for 14 paces), and then the "Results" key "R". The computing means will immediately output at the display 12 the backstroke instruction for the putt, e.g., 11 inches.

The same methodology is used for the scenario of FIG. 6. Assuming a predetermination of 12 paces by the golfer of the distance D" and of a moderate uphill grade of the inclined green surface GS, the computing means would be inputted by the sequential keying of "MoU", "1", "2" and "R"; the displayed instruction would advise the golfer to have a 12 inch backstroke for the putt. If a grade of major uphill had been pre-determined, then the sequential keying would be "MaU", "1", "2" and "R" and the instruction to the golfer would be to have a 14 inch backstroke. If a slightly uphill grade had been predetermined, then the sequential keying would be "SIU", "1", "2" and "R" and the instruction would be for a backstroke of 11 inches. These examples show the direct relationship between the "steepness" of the uphill grades and the lengths of the recommended backstrokes.

The declining slope or grade depicted in FIG. 7 would be analyzed by the golfer and a determination would be made. The keying of the computing means would first key in the appropriate grade as selected from keys "SID", "MoD", or "MaD". Then the distance D"' is keyed in using the appropriate keys in row 18 of the keypad of AA. The "R" key is touched. The computing means then immediately displays, i.e., outputs the putting backstroke instruction.

Figure 8:
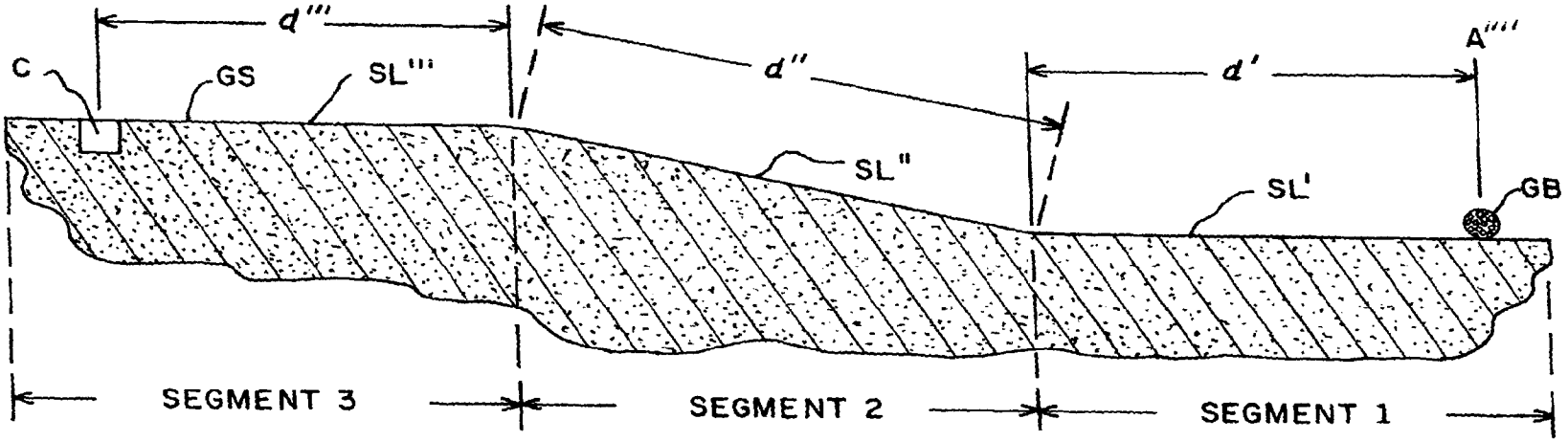
FIG. 8 is a diagram for a multi-segment putt.

Multi-segment putting scenarios are frequently encountered during recreational play. FIG. 8 is a diagram of a typical multi-segment putting green scenario. A first Segment 1 begins at A"", the initial location of the golf ball GB. Segment 1 is predetermined by the golfer to have a grade SL' and a measured distance d'. A connecting, intermediate segment Segment 2 is evaluated by the golfer to have a grade SL", and a distance d". The final segment Segment 3 is predetermined to have a grade SL'" and a distance d'". The golfer sequentially inputs the applicable grade and length of Segments 1, 2 and 3 respectively into the computing means using the keypad input means. The computing means is programmed to total the data for all of the segments so inputted and then output an instruction to the golfer for the required backstroke of the golfer's putter so as to have the putted golf ball traverse the entire green surface GS from the ball's initial position A"" to the cup C. For example, assume the following predeterminations of the three segments of FIG. 8 were: Segment 1 (grade is SIU and d' is 12 paces); Segment 2 (grade is MaU and d" is 8 paces); and Segment 3 (grade is level Le and d'" is 6 paces). It might be observed that the assumed putt of 26 total paces is a very long putt. The inputting of the data into the computing means would be the sequential keying of "SIU", "1", "2", "+", "MaU", "8" "+", "Le", "6" & "R". The computing means would totalize the inputted information and output an instruction that the recommended backstroke should be 25 inches.

The "AGWG" key may be selectively used by the golfer who has the capability to determine the grain of the grass on the green along the path of the intended putt. If the determination is that the putt will be traveling on a path having a component going against the grain of the grass, then the AGWG key is touched to select AG. For the case of the planned putt having a component going with the grain, then the AGWG key is touched to select WG. The AGWG key alternates, when touched, between the AG and WG functions.

Figure 9:
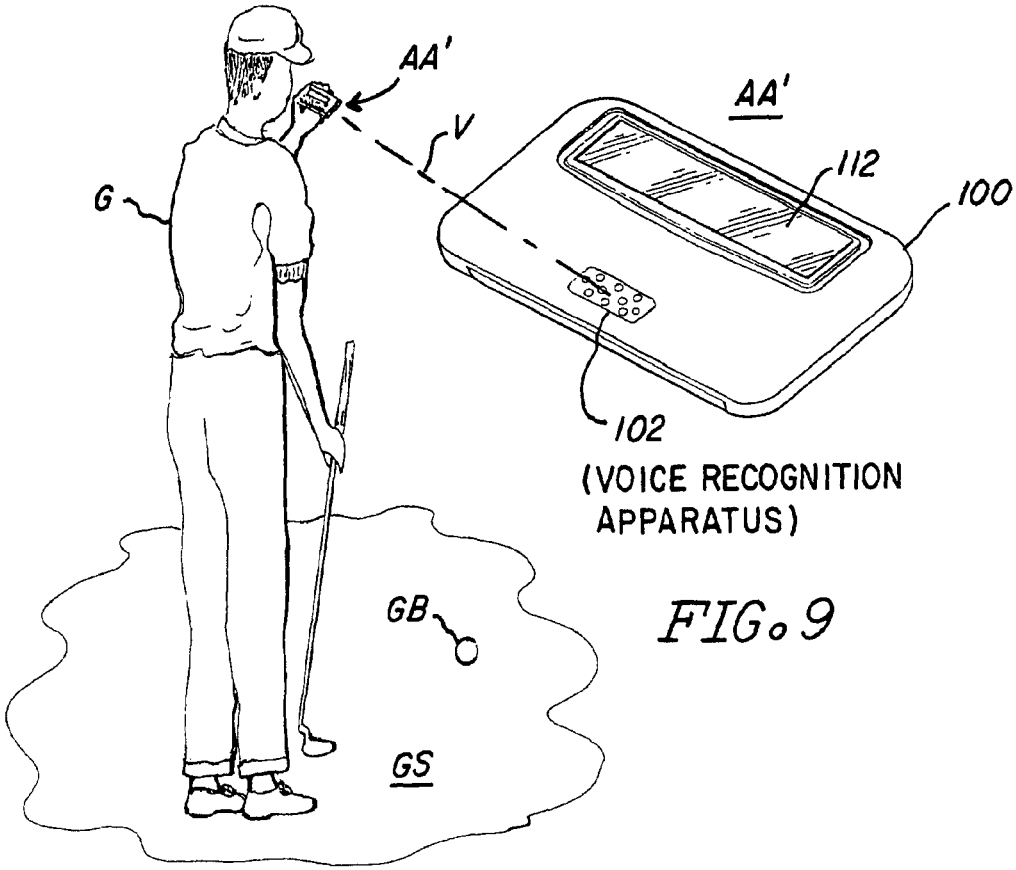
FIG. 9 is a block diagram of a computer means having artificial intelligence input means.

The modification of our invention shown in FIG. 9 is representative of a computing means AA' having artificial intelligence-type input means 102 using well known technology, an example being the converting of voice commands into a control signal. As depicted, the computing means AA' would include a display-type output means 112 but would not necessarily, but could optionally include a keypad means. In the diagram of FIG. 9, a golfer G inputs grade and distance data to the initialized computing means AA' by speaking specific commands at the input means, i.e., voice recognition means or apparatus 102. The golfer's voice V is shown in FIG. 9 being directed toward the input means 102. The computing means, after receiving the input commands by the voice V of the golfer G, provides the backstroke putting instruction to the golfer via the output means 112.

Figure 10:
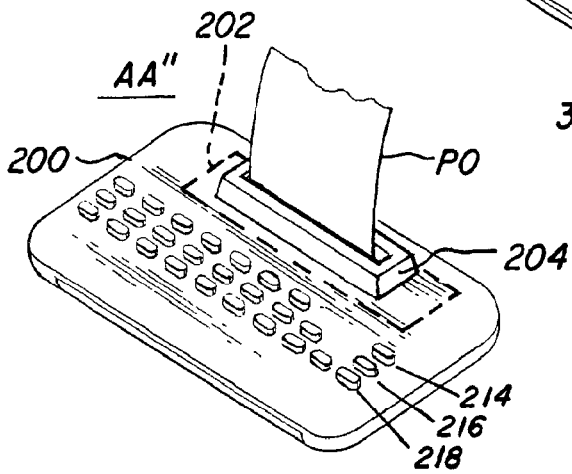
FIG. 10 is a view of a modified computer means having a hard copy output means.

The embodiment of our invention shown in FIG. 10 is designated AA", a computing means having a housing 200 and a keypad-type input means, i.e., rows of keys 214, 216 and 218. Instead of a visual display-type output means of the type shown in FIG. 1, a "hard copy" delivering output means 202 is shown, internal of the housing 200 and, using well known technology, processing the output signal of the computing means to deliver a hard copy print out PO from a dispensing head 204. In use, the golfer would input the grade and length of each segment for each planned putt using the keypad means. The output instruction for the length of the needed backstroke is automatically printed at PO.

Figure 11:
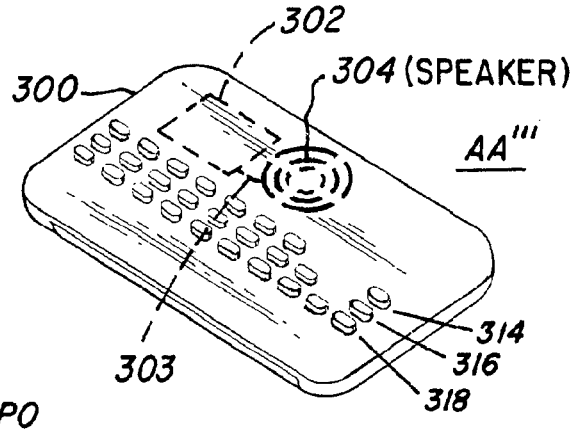
FIG. 11 is a view of a modified computer means having an audible output means.

An audio output-type of output means is provided in the embodiment of our invention illustrated in FIG. 11. A computing means AA'" comprises a housing 300 having keypad means 314, 316 and 318 for the inputting of data. An internal audio amplifier means 302 receives the output from the computer means and is connected, via connection means 303, to an audio speaker-like means 304. The computer means AA'" would function, similar to apparatus AA of FIG. 1, to receive the input data from the golfer using the keypad means. However, instead of a visual display-type output means, the output backstroke instruction is provided as an audio message.

Figure 12:
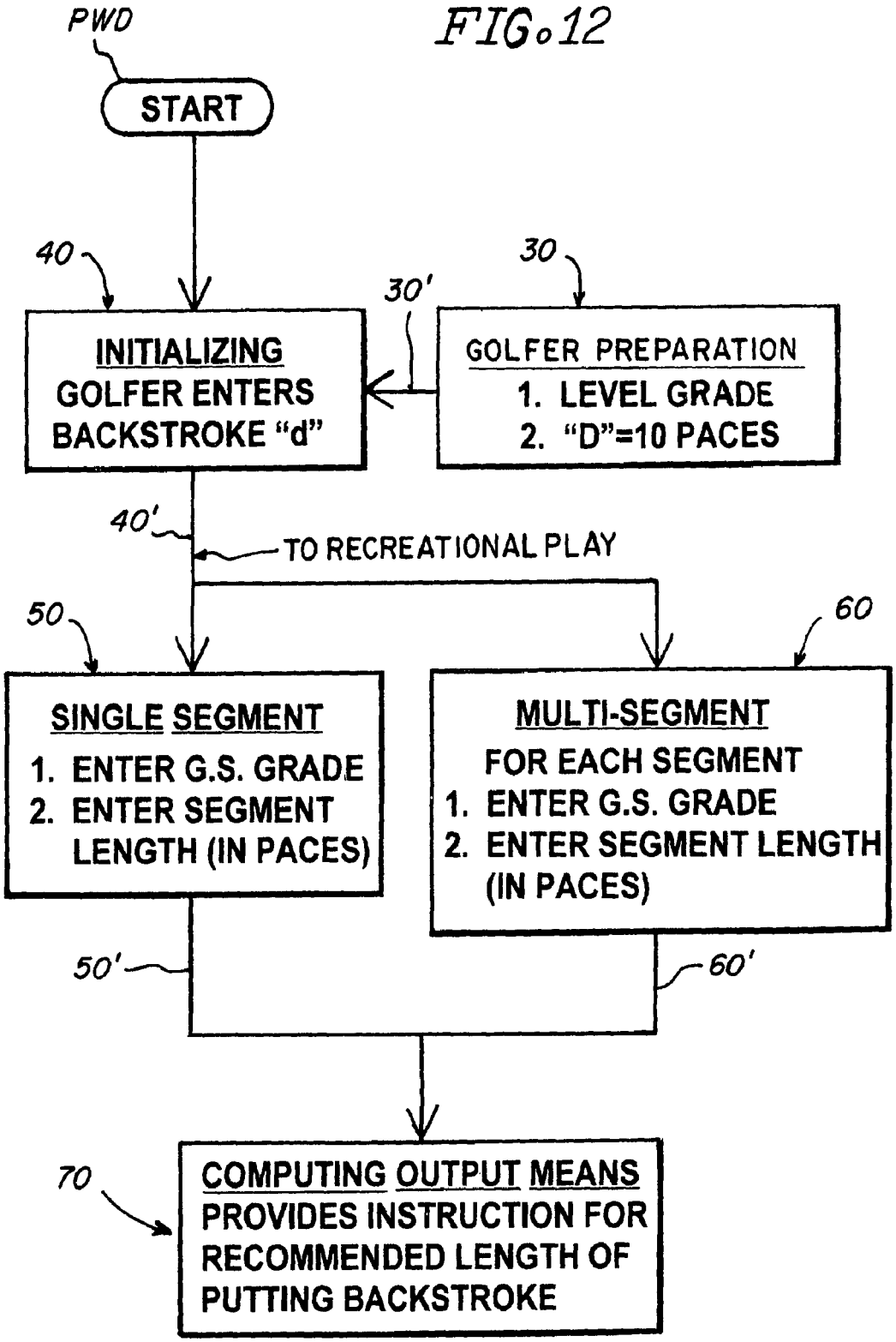
FIG. 12 is a flow chart for the method and computing means of our preferred embodiment.

FIG. 12 is a simplified flow chart of the methodology and apparatus of the preferred embodiment of our invention. A start function (key PWD) is connected to an initializing function block 40 which had received a prior factory set reference base of a level grade and a distance D of 10 paces (all as discussed above). A golfer preparation function block 30 (connected via 30' to block 40) is indicative of the golfer selecting a level area of the green, pacing off ten paces, and marking the paced distance with two markers on said level area of the green (see FIGS. 2-4). The golfer would then putt one or more golf balls until a putted ball stopped either at or close to the second of the markers, the length "d" of the putting backstroke which produced the desired result being noted by the golfer and entered as is shown in function block 40.

After the initialization, the output 40' of initializing function block 40 is available for recreational play, i.e., single segment or multi-segment greens represented by function blocks 50 and 60 respectively.

Referring to function block 50 for a single segment type green, the golfer simply enters the grade and the length of the segment, the length of the segment being as measured by the number of the golfer's own paces all as above described. The output 50' of block 50 is shown connected to computing output means 70.

For a multi-segment scenario represented by function block 60, the golfer simply enters, for each segment, the grade and length as above described. As explained above, the computing means will totalize the data for all of the segments upon the touching of the "R" key. The output 60' of block 60 is shown connected to computing output means 70.

Finally, after the aforesaid data has been entered into the computing means AA, the computing output means 70 will output the instruction for the recommended length of the backstroke for the golfer to achieve a putt that results in the golf ball traveling across the green surface either into or close to the cup.

Figure 13:
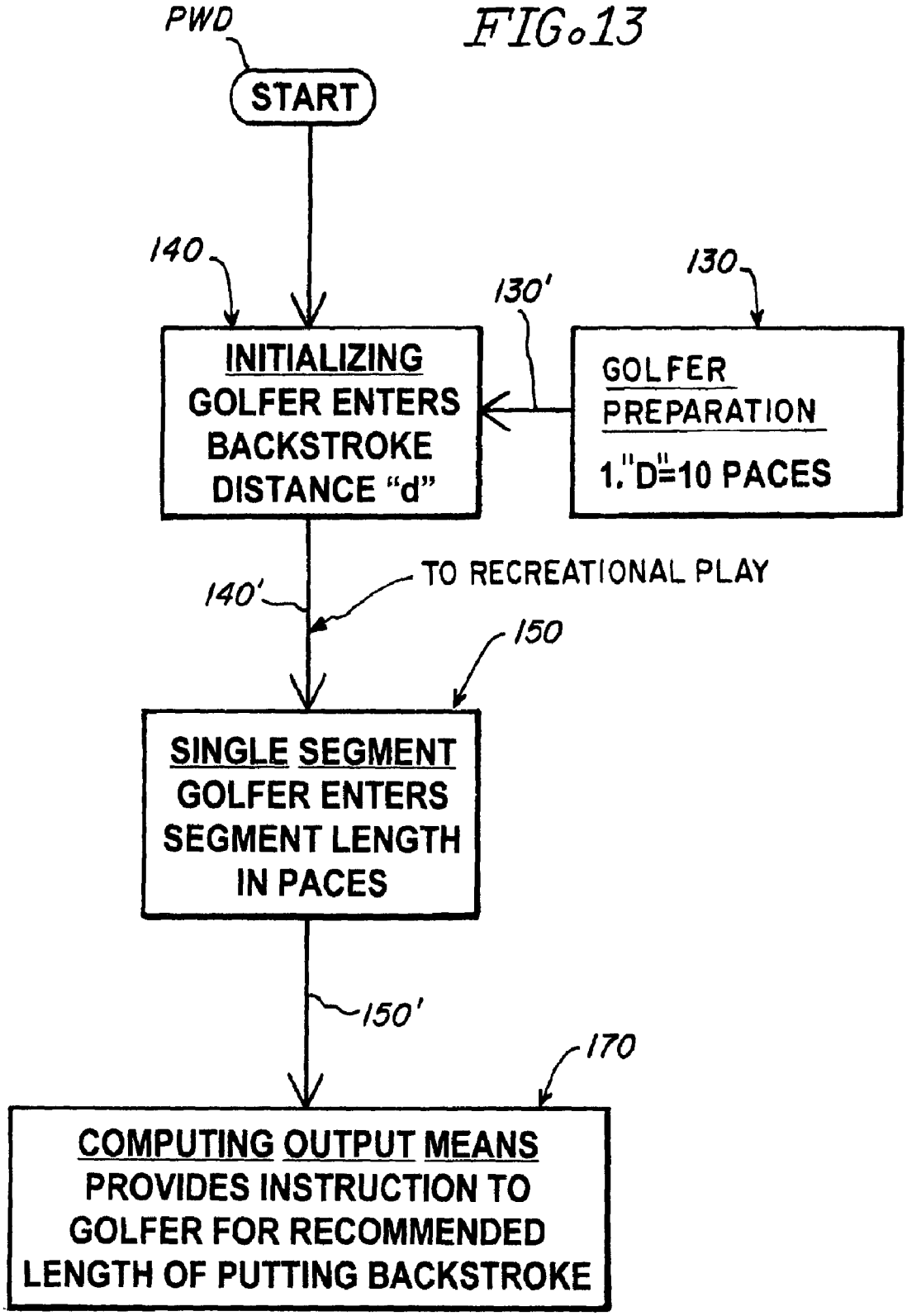
FIG. 13 is a flow chart for the methodology of an alternate embodiment of our invention.

An alternate embodiment of our invention is shown functionally in FIG. 13. This embodiment provides a putting backstroke instruction to the recreational golfer using a computing means initialized at the factory only with a pre-selected distance, e.g., 10 paces. For this embodiment, the computing means is not programmed with a pre-selected grade. The golfer preparation simply is to pace off the pre-selected number of paces and then putt one or more golf balls as aforesaid to determine the length of the backstroke "d". This embodiment has the advantage of reduced cost of manufacture of the computing means. Also, the golfer would have a somewhat simplified operating procedure because of the exclusion of green grade data. For some scenarios, the exclusion of the green grade data is not problematic; for other greens having significant grades, our preferred embodiment would be the desired choice.

Thus, in FIG. 13 the start PWD is connected to an initializing function block 140 which also is linked, via 130', to a golfer preparation function block 130 to validate that the golfer had paced off a pre-programmed distance "D" of 10 paces on the green. The golfer putts one or more golf balls until achieving a satisfactory initializing putt. The distance "d" of the associated backstroke is noted and is inputted into the computing means as shown in block 140. The initializing is coupled, via 140', to a single segment function block 150 where, for this embodiment of our invention, the single segment is defined as the total length, in paces, of the planned putt. The golfer enters the length of the segment of the planned putt. This data is coupled, via 150' to the computing means and a computing output means 170 provides an instruction to the golfer for the recommended length of the putting backstroke.

In summary, we have shown and described our preferred embodiment or our invention as well as an alternate embodiment. Other embodiments of our invention may be made by those skilled in the art without departing from our teaching herein. Therefore, it is to be understood that our invention is to be limited only by the scope of the following claims.

We claim:

1. A method for calculated putting, comprising the steps of:

establishing a first point across a pre-selected grade on a green surface that is a preselected number of pacing steps from a golf ball;

marking said first point;

putting said golf ball to said first point white noting a backstroke length effective for said putt;

initializing a pre-programmed computing means by inputting said backstroke length effective for said putt;

inputting into said computing means, for each segment of a planned putt on a specific green, the length of said each segment;

outputting for said planned putt from output means of said computing means the necessary length of backstroke to cause a putted ball to travel across said specific green close to a cup thereof, said necessary backstroke length which is dependent upon and varies responsive to said backstroke length effective to putt said golf ball to said first point input during said initializing step; and putting with a backstroke modified in accord with said necessary length of backstroke;

further comprising the step of storing said preselected number of pacing steps as a number in said pre-programmed computing means prior to said inputting step; and wherein the steps of storing said preselected number of pacing steps, establishing a first point, marking said first point, putting said golf ball, and initializing a pre-programmed computing means comprise initialization of said pre-programmed computing means that indirectly determines real-time green resistance.

2. The method of claim 1 including the further step of inputting into said computing means, for said each segment of a multi-segment planned putt, the grade and a number of paces of said each segment of a multi-segment planned putt.

3. The method of claim 1 wherein said pre-selected grade is a level grade.

4. The method for calculated putting of claim 1, wherein said step of inputting said backstroke length effective for each putt further comprises the step of entering a number into said pre-programmed computing means representative of an estimate of a distance of said backstroke length.

5. The method for calculated putting of claim 1, further comprising the step of initiating said initialization of said pre-programmed computing means immediately prior to play.

6. A method for calculated putting, comprising the steps of:

storing a calibration number in a pre-programmed computing means;

establishing a first point across a pre-selected grade on a green surface that is a preselected number of pacing steps from a golf ball, said preselected number of pacing steps equal to said calibration number;

marking said first point;

putting said golf ball to said first point while noting a backstroke length effective for said putt;

initializing said pre-programmed computing means by inputting said backstroke length effective for said putt;

inputting into said computing means, for each segment of a planned putt on a specific green, a length of said each segment;

outputting for said planned putt from output means of said computing means the necessary length of backstroke to cause a putted ball to travel across said specific green close to a cup thereof, said necessary backstroke length which is dependent upon and varies responsive to said backstroke length and said length of said each segment; and putting with a backstroke modified in accord with said necessary length of backstroke; wherein the steps of storing, establishing, marking, putting, and initializing comprise initialization of said pre-programmed computing means that indirectly determines real-time green resistance.

7. The method for calculated putting of claim 6, wherein said step of inputting into said pre-programmed computing means further comprises, for said each segment of a multi-segment planned putt, inputting the grade and a number of paces of said each segment of said multi-segment planned putt.

8. The method for calculated putting of claim 6, wherein said pre-selected grade is a level grade.

9. The method for calculated putting of claim 6, further comprising the step of storing a preselected grade in said pre-programmed computing means prior to said inputting step.

10. The method for calculated putting of claim 6, wherein said step of initializing further comprises the step of entering a number into said pre-programmed computing means representative of an estimate of a distance of said backstroke length.

11. The method for calculated putting of claim 6, further comprising the step of calculating a necessary backstroke length to cause a putted ball to travel across said specific green close to a cup thereof, said necessary backstroke length which is dependent upon and varies responsive to said input length of said each segment and responsive to said entered backstroke length.

12. The method for calculated putting of claim 6, wherein said length of said each segment further comprises an ascertained number of paces required to traverse said each segment.

13. A method for calculated putting which factors real-time stimp resistance into an initialization procedure pre-programmed within a pre-programmed computing means, comprising the steps of:

storing a pre-selected number of paces and a pre-selected grade within said pre-programmed computing means;

initiating an initialization procedure pre-programmed within said pre-programmed computing means;

outputting from said pre-programmed computing means said pre-selected number of paces and said pre-selected grade, responsive to said initiating step;

establishing a first point across a pre-selected grade on a green surface that is said preselected number of paces from a golf ball;

marking said first point;

determining a backstroke length effective for putting said golf ball to said first point;

entering a number representative of said determined backstroke length into said pre-programmed computing means during said initialization procedure and thereby indirectly determining said real-time stimp resistance into subsequent calculations of backstroke length;

ascertaining, for each segment of a planned putt on a specific green, a number of paces required to traverse said each segment;

inputting into said computing means said ascertained number of paces required to traverse said each segment, said inputting step subsequent to said pre-programmed computing means initialization procedure;

calculating a necessary backstroke length to cause a putted ball to travel across said specific green close to a cup thereof, said necessary backstroke length which is dependent upon and varies responsive to said number of paces required to traverse said each segment and responsive to said entered backstroke length;

outputting for said planned putt from output means of said computing means said necessary backstroke length; and putting with a backstroke modified in accord with said necessary length of backstroke.

14. The method for calculated putting of claim 13, wherein said step of inputting into said pre-programmed computing means further comprises, for said each segment of a multi-segment planned putt, inputting the grade of said each segment of said multi-segment planned putt.

15. The method for calculated putting of claim 13, wherein said pre-selected grade is a level grade.

* * * * *